US009045260B2

(12) United States Patent
Norris et al.

(10) Patent No.: US 9,045,260 B2
(45) Date of Patent: Jun. 2, 2015

(54) BEVERAGE DISPENSING SYSTEM

(71) Applicant: The Coca-Cola Company, Atlanta, GA (US)

(72) Inventors: Joseph T. Norris, Cumming, GA (US); Javier Verdura, Milford, CT (US); Jesse S. Kruska, New Haven, CT (US); James McCay, Fairfield, CT (US); John P. Kalinowsky, Danbury, CT (US); Roberto WaChong Castro, Heredia (CR)

(73) Assignee: The Coca-Cola Company, Atlanta, GA (US)

( * ) Notice: Subject to any disclaimer, the term of this patent is extended or adjusted under 35 U.S.C. 154(b) by 59 days.

(21) Appl. No.: 13/784,887

(22) Filed: Mar. 5, 2013

(65) Prior Publication Data

US 2014/0252031 A1 Sep. 11, 2014

(51) Int. Cl.
*B65D 35/56* (2006.01)
*B67D 3/00* (2006.01)

(52) U.S. Cl.
CPC ..... *B65D 35/565* (2013.01); *B67D 3/0029* (2013.01); *B67D 3/0054* (2013.01); *B67D 3/0067* (2013.01); *B67D 3/0083* (2013.01)

(58) Field of Classification Search
CPC ..... B67D 3/041; B67D 3/0009
USPC ..... 222/1, 105, 181.1–181.3, 184
See application file for complete search history.

(56) References Cited

U.S. PATENT DOCUMENTS

| | | | | | |
|---|---|---|---|---|---|
| 2,070,398 | A | | 2/1937 | Freund | |
| 3,212,681 | A | * | 10/1965 | Weikert | 222/183 |
| 3,435,990 | A | * | 4/1969 | Pike, Jr. | 222/1 |
| 4,573,612 | A | * | 3/1986 | Maddison et al. | 222/105 |
| 4,634,022 | A | * | 1/1987 | O'Halloran et al. | 222/95 |
| 4,921,136 | A | * | 5/1990 | Roggenburg, Jr. | 222/95 |
| 5,025,955 | A | | 6/1991 | Stenger | |
| 5,102,015 | A | * | 4/1992 | Barnard et al. | 222/135 |
| 5,248,066 | A | * | 9/1993 | Olson et al. | 222/105 |
| 5,619,856 | A | | 4/1997 | Lee | |
| 5,638,989 | A | * | 6/1997 | Ophardt et al. | 222/105 |
| 5,833,120 | A | * | 11/1998 | Evans et al. | 222/95 |

(Continued)

FOREIGN PATENT DOCUMENTS

| | | |
|---|---|---|
| EP | 0360456 A2 | 3/1990 |
| EP | 0559924 | 9/1993 |

(Continued)

OTHER PUBLICATIONS

U.S. Appl. No. 61/602,673, filed Feb. 24, 2012, Norris, et al.

(Continued)

*Primary Examiner* — Donnell Long
(74) *Attorney, Agent, or Firm* — Sutherland Asbill & Brennan LLP

(57) ABSTRACT

The present application provides a beverage dispensing system for dispensing a number of beverages. The beverage dispensing system may include a housing, a pouch with one of the beverages therein, the pouch including a first pouch end and a second pouch end, and a beverage basket removably positionable within the housing. The beverage basket may include a pouch clip for the first pouch end and a slanted floor for the second pouch end such that the pouch may be positioned substantially vertically therein for good evacuation of the beverage from the pouch.

17 Claims, 5 Drawing Sheets

(56) References Cited

U.S. PATENT DOCUMENTS

| | | | | |
|---|---|---|---|---|
| 6,026,988 | A | 2/2000 | Teetsel et al. | |
| 6,073,811 | A | 6/2000 | Castea | |
| 6,112,537 | A | 9/2000 | Broadbent | |
| 6,186,361 | B1 * | 2/2001 | Teetsel, III | 222/1 |
| 6,223,944 | B1 * | 5/2001 | Gehl et al. | 222/94 |
| 6,419,121 | B1 * | 7/2002 | Gutierrez et al. | 222/146.5 |
| 6,450,214 | B1 | 9/2002 | Dyer et al. | |
| 6,488,179 | B1 * | 12/2002 | Vujicic et al. | 222/132 |
| 6,497,343 | B1 | 12/2002 | Teetsel, III | |
| 6,708,741 | B1 * | 3/2004 | Berry et al. | 141/362 |
| 6,755,325 | B2 * | 6/2004 | Haase et al. | 222/96 |
| 6,877,642 | B1 * | 4/2005 | Maddox et al. | 222/181.3 |
| 6,892,903 | B1 | 5/2005 | Bartolotta | |
| 6,938,801 | B1 * | 9/2005 | Reddy et al. | 222/214 |
| 8,313,007 | B2 * | 11/2012 | Kpabar | 222/108 |
| 2004/0177893 | A1 | 9/2004 | Younkle | |
| 2004/0195393 | A1 | 10/2004 | Younkle | |
| 2005/0072487 | A1 | 4/2005 | Younkle | |
| 2008/0023487 | A1 * | 1/2008 | Douwes | 222/105 |
| 2012/0104041 | A1 | 5/2012 | Coleman et al. | |
| 2012/0138635 | A1 | 6/2012 | Norris et al. | |

FOREIGN PATENT DOCUMENTS

| | | | |
|---|---|---|---|
| EP | 1462412 | A2 | 9/2004 |
| GB | 2286384 | | 8/1995 |
| GB | 2335412 | | 9/1999 |
| WO | 96/31403 | A1 | 10/1996 |
| WO | 01/17892 | A2 | 3/2001 |

OTHER PUBLICATIONS

International Search Report and Written Opinion, dated Jun. 4, 2014.

* cited by examiner

BEVERAGE DISPENSING SYSTEM

TECHNICAL FIELD

The present application and the resultant patent relate generally to dispensing systems and more particularly relate to a beverage dispensing system that dispenses premixed or otherwise ready to drink beverages without the use of a refrigeration system or electro-mechanical devices.

BACKGROUND OF THE INVENTION

Generally described, modern beverage dispensers may be relatively complex electro-mechanical devices. A typical beverage dispenser may mix multiple ingredients to produce a beverage via a combination of pumps, valves, and other components as directed by an electronic controller and the like. Such complex electro-mechanical beverage dispensers, however, may not be suitable for use in all locations. For example, the size or cost of the beverage dispenser may not be practical for a given location, the location may lack reliable electric power, the location may lack portable water supplies, the location may lack the infrastructure required to provide or store the different beverage ingredients, and other types of factors that may limit use. These factors also may have an impact on the reliability of the beverage dispenser and/or the quality of the beverages dispensed therefrom.

There is thus a desire for an improved beverage dispensing system that does not require complex electro-mechanical components to operate. Preferably, such a beverage dispensing system may provide premixed or otherwise ready to drink beverages in a low cost and efficient manner that maintains the quality of the beverage, ease of dispensing and evacuating, and the like over an extended period of time.

SUMMARY OF THE INVENTION

The present application and the resultant patent thus provide a beverage dispensing system for dispensing a number of beverages. The beverage dispensing system may include a housing, a pouch with one of the beverages therein, the pouch including a first pouch end and a second pouch end, and a beverage basket removably positionable within the housing. The beverage basket may include a pouch clip for the first pouch end and a slanted floor for the second pouch end such that the pouch may be positioned substantially vertically therein for good evacuation of the beverage from the pouch.

The present application and the resultant patent further provide a method of dispensing a beverage from a pouch. The method may include the steps of chilling the pouch with the beverage therein in a refrigerator, attaching a first end of the pouch to a beverage basket by a pouch clip, positioning a second end of the pouch about a slanted floor of the beverage basket, positioning the beverage basket within an insulated housing, attaching the pouch to a dispensing mechanism, dispensing a portion of the beverage from the pouch, and returning the beverage basket, the pouch, and any remaining beverage to the refrigerator.

The present application and the resultant patent further provide a beverage dispensing system for dispensing a number of beverages. The beverage dispensing system may include an insulated housing, a flexible pouch with one of the beverages therein, the pouch may include a first pouch end and a second pouch end, a beverage basket removably positionable within the housing, and a dispensing mechanism attachable to the pouch. The beverage basket may include a pouch clip for the first pouch end and a slanted floor for the second pouch end such that the pouch may be positioned substantially vertically therein and attached to the dispensing mechanism for good evacuation of the beverage from the pouch.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
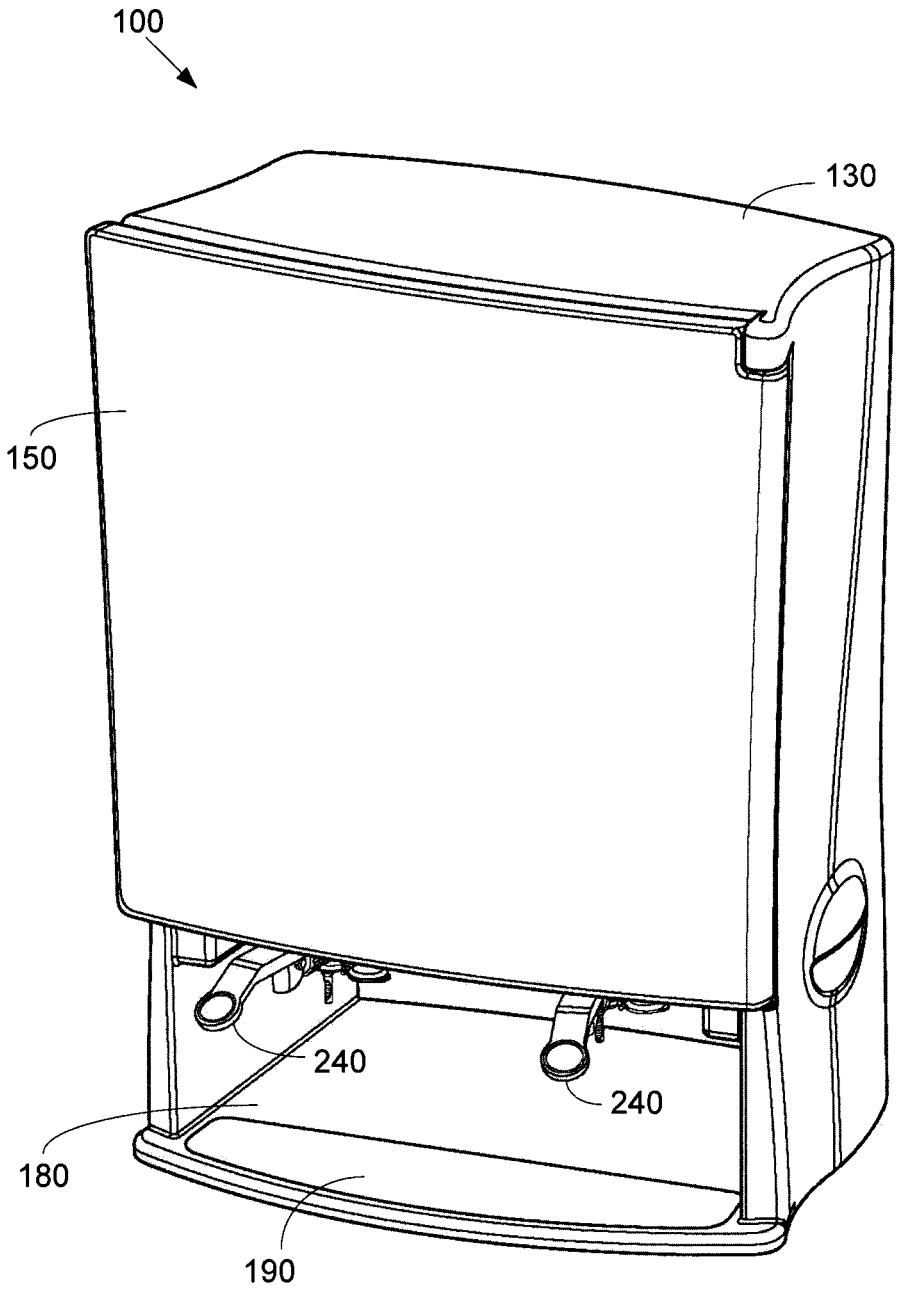
FIG. 1 is a perspective view of a beverage dispensing system as may be described herein.
Figure 2:
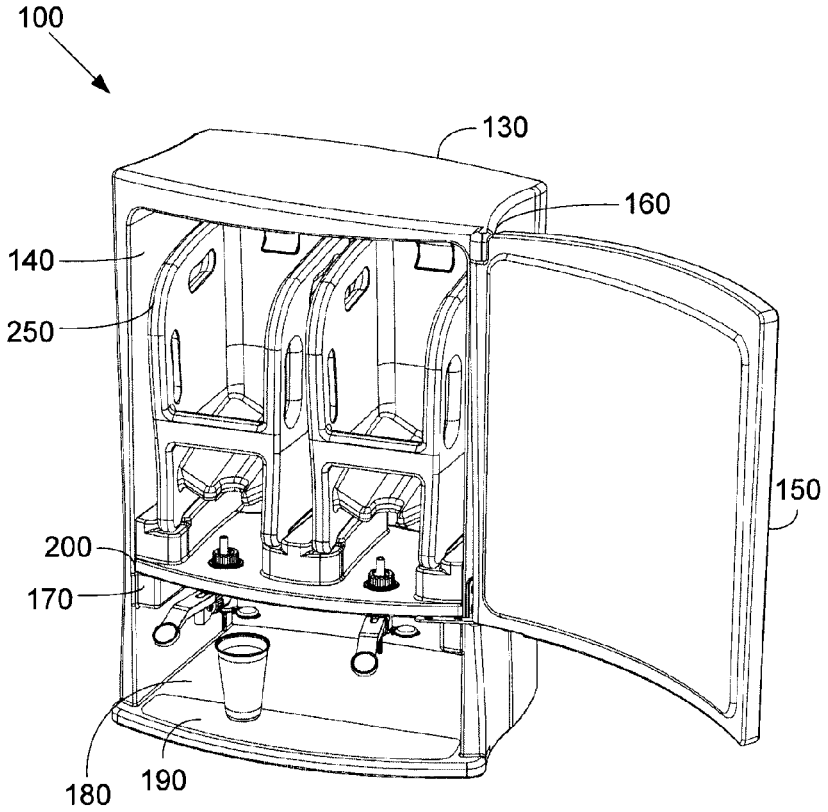
FIG. 2 is a further perspective view of the beverage dispensing system of FIG. 1 with the front door open.

Referring now to the drawings, in which like numerals refer to like elements throughout the several views, FIG. 1 and FIG. 2 show a beverage dispensing system 100 as may be described herein. The beverage dispensing system 100 may dispense a number of beverages 110. The beverages 110 may include a number of premixed or otherwise ready to drink beverages. The beverages 110 may include waters, juices, flavored drinks, sports drinks, coffees, teas, and the like. Generally described, any type of non-carbonated beverage 110 may be used herein. Combinations of beverages and other ingredients may be used. Other types of fluids may be used herein.

The beverages 110 may be stored within a pouch 120. The pouch 120 may be a flexible pouch made out of a thermoplastic material and the like. The pouch 120 may be similar to a conventional bag-in-box pouch and may contain internal structures to assist in draining. Each pouch 120 may contain about five (5) to about ten (10) liters of a beverage 110. The pouches 120 may have any size, shape, or configuration. Bottles, other types of containers, and the like also may be used to store the beverages 110 therein. Other components and configurations also may be used herein.

The beverage dispensing system 100 may include a housing 130. The housing 130 may have any size, shape, or configuration. The housing 130 may be made from a thermoplastic and a thermally insulating material. Thermoplastics such as polyethylene, polyurethane, and the like may be used and manufactured in a rotational molding process. Other types of materials with good insulating characteristics and other types of manufacturing techniques also may be used herein. The insulating material may include polyurethane, polyester, and the like.

Figure 3:
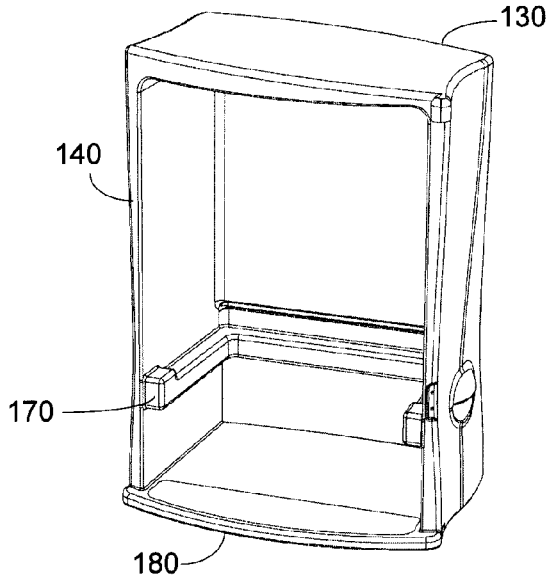
FIG. 3 is a perspective view of the housing of the beverage dispensing system of FIG. 1.

The housing 130 may define an interior product space 140. The interior product space 140 may have any size, shape, or configuration. The interior product space 140 may be enclosed by a door 150. The door 150 may rotate about the housing 130 via a hinge 160. Other types of access and opening means also may be used herein. As is shown in FIG. 3, a ledge 170 may be formed within the housing 130 as will be described in more detail below. The housing 130 also may define a dispensing area 180 beneath the interior product space 140. The dispensing area 180 may have any size, shape, or configuration. The dispensing area 180 may be unenclosed about the front and rear thereof. A drip plate 190 may be machined or otherwise formed therein. Other components and other configurations may be used herein.

Figure 4:
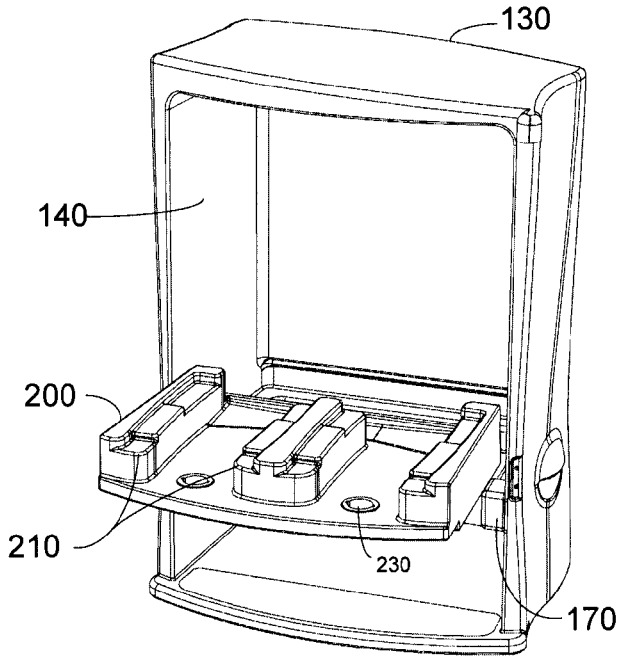
FIG. 4 is a perspective view of the beverage dispensing system of FIG. 1 with a product shelf being removed.
Figure 5:
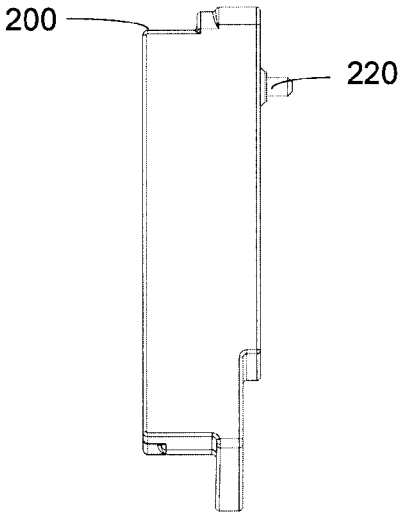
FIG. 5 is a side plan view of the product shelf of FIG. 4.

As is shown in FIG. 4 and FIG. 5, a product shelf 200 may be positioned within the housing 130. The product shelf 200 also may be made out of an insulated thermoplastic similar to that described above. The product shelf 200 may have any size, shape, or configuration. The product shelf 200 may be positioned about the ledge 170 of the housing 130. The product shelf 200 may have a number of basket guides 210 formed therein. The basket guides 210 may have any size, shape, or configuration. Any number of the basket guides 210 may be used herein. The product shelf 200 also may include a drainage tube 220 positioned thereon to drain any condensation and the like about the pouches 120. Any number of the drainage tubes 220 may be used herein. Other types of drainage means may be used herein.

The product shelf 200 also may have a number of dispensing mechanism apertures 230. The dispensing mechanism apertures 230 may be used with a dispensing mechanism 240 as is shown in FIG. 2 and the like. Any number of the dispensing mechanism apertures 230 and the dispensing mechanisms 240 may be used herein. The dispensing mechanism 240 may be similar to those shown in commonly owned U.S. Publication No. 2012/01138635 to Norris, et al. and/or commonly owned U.S. Provisional Application Ser. No. 61/602,673 to Norris, et al. U.S. Publication No. 2012/01138635 and U.S. Provisional Application Ser. No. 61/602,673 are incorporated herein by reference in full. Other types of dispensing mechanisms 240 may be used herein.

Figure 6:
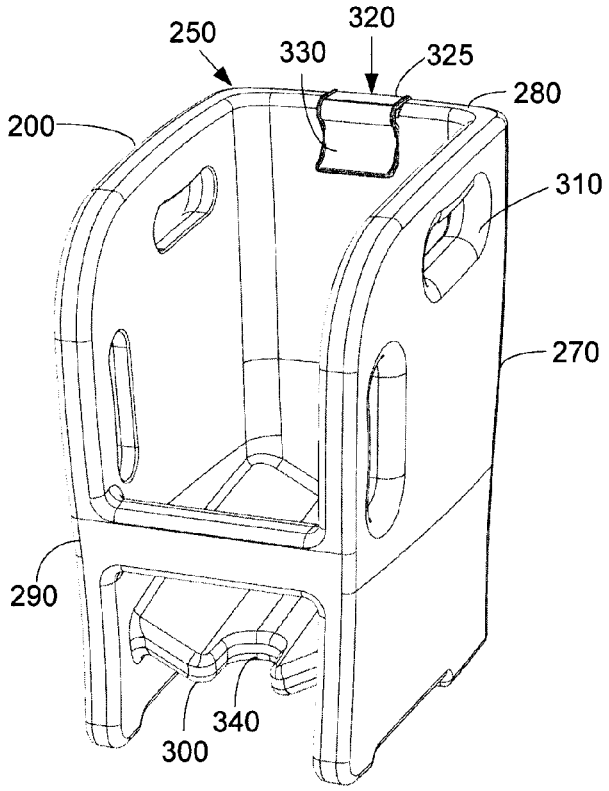
FIG. 6 is a perspective view of a beverage pouch basket as may be used with the beverage dispensing system of FIG. 1.
Figure 7:
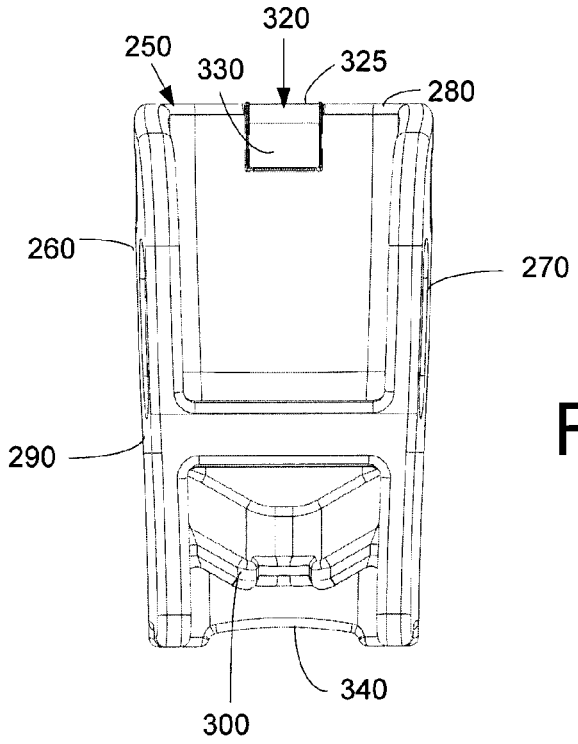
FIG. 7 is a front plan view of the beverage pouch basket of FIG. 6.

FIG. 6 and FIG. 7 show a beverage pouch basket 250. The beverage pouch basket 250 may be made from an insulated thermoplastic material such that described above. The beverage pouch basket 250 may have of any size, shape, or configuration. The beverage pouch basket 250 may include a first sidewall 260, a second sidewall 270, a rear wall 280, a front support bar 290, and a slanted floor 300. Each of the sidewalls 260, 270 may have a number of hand grips 310 formed therein. The hand grips 310 may have any size, shape, or configuration.

The rear wall 280 may have one or more pouch clips 320 attached thereto. The pouch clips 320 may be made out of any type of material with some flexibility and memory. The pouch clip 320 may include an attachment end 325 and an extended lip 330. A portion of the pouch 120 may be positioned against the rear wall 280 by the extended lip 330 of the pouch clip 320 and retained therein. Any number of pouch clips 320 may be used herein.

The slanted floor 300 may slant downwardly from a lower portion of the sidewalls 260, 270 and the rear wall 280 to a pouch aperture 340. The pouch aperture 340 may be sized for a pouch fixture 350 of the pouch 120 to extend therethrough. The slanted floor 300 may have any size, shape, or configuration. The sidewalls 260, 270 and the rear wall 280 may extend beyond the bottom of the slanted floor 300 such that the beverage pouch basket 250 may stand thereon without tipping when the pouch 120 is positioned therein. The combination of the pouch clip 320 and the slanted floor 300 promote good evacuation of the beverage 110 from the pouch 120. Other components and other configurations may be used herein.

Figure 8:
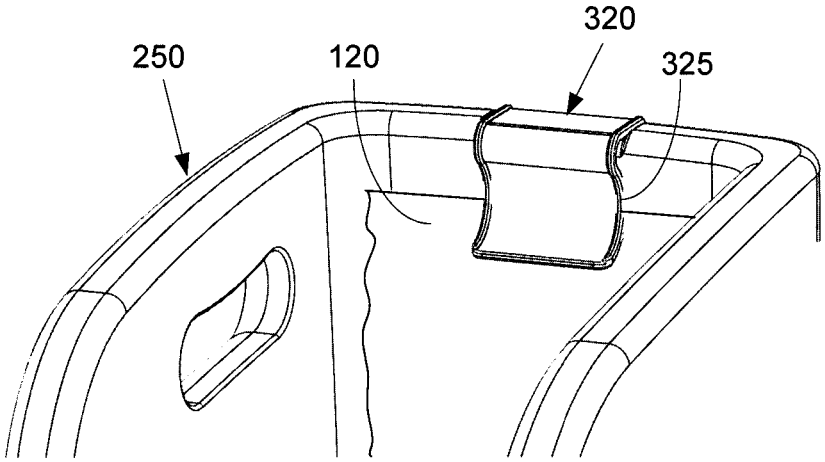
FIG. 8 is a perspective view of the beverage dispensing system of FIG. 1 with a beverage pouch installed.

In use, a pouch 120 may be positioned within the beverage pouch basket 250. As is shown in FIG. 8, an upper end of the pouch 120 may be secured via the pouch clip 320 while the pouch fixture 350 extends through the pouch aperture 340. Preferably, the pouch 120 and the beverage 110 therein have been pre-chilled in a refrigerator. The beverage pouch basket 350 may then be installed within the housing 130 along the basket guides 210 of the product shelf 200. The pouch fixture 350 may be attached to the dispensing mechanism 240 and the door 150 may be closed. Any number of pouches 120 and beverage pouch baskets 250 may be used herein. The beverage 110 therein is now ready to be dispensed from the beverage dispensing system 100.

By pre-chilling the beverages 110 and the pouches 120 before use and by using the insulated thermoplastics for the components herein, the beverage dispensing system 100 may keep the beverages 110 cool or cold for an extended period of time without the use of refrigeration devices. Rather, the retained heat within the pouches 120 may be sufficient to keep the beverages 110 cool or cold. The pouches 120 in the beverage pouch baskets 250 may be removed from the housing 130 at the end of the day and placed in a refrigerator until needed again. The length of time that the beverages 110 remain chilled may depend in part on local ambient conditions.

The beverage dispensing system 100 described herein thus provides a low cost device for dispensing chilled beverages 110. The beverage dispensing system 100 provides efficient dispensing of beverages 110 without the use of refrigeration, without the use of electro-mechanical parts, and even without the use of electricity. The beverage dispensing system 100 thus may be used in almost any location without regard to local conditions. The beverage dispensing system 100 also may be portable. Moreover, the components of the beverage dispensing system 100 may be largely modular for ease of construction, maintenance, and replacement.

Although the beverage dispensing system 100 has been described herein as providing chilled beverages 110, the beverage dispensing system 100 also may be used to store and dispense heated beverages such as coffee, tea, and the like. Similar to the steps described above, the beverage 100 may be preheated, attached to the beverage pouch basket 250, installed within the housing 130, and dispensed.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A beverage dispensing system for dispensing a number of beverages, comprising:

a housing comprising an interior product space and a dispensing area disposed below the interior product space;

a ledge disposed within the housing between the interior product space and the dispensing area;

a removable product shelf positionable about the ledge, wherein the removable product shelf separates the interior product space from the dispensing area, and wherein the removable product shelf comprises a basket guide formed thereon and a drainage tube extending therethrough;

a pouch with one of the beverages therein;

the pouch comprising a first pouch end and a second pouch end; and a beverage basket removably positionable on the basket guide of the removable product shelf within the interior product space of the housing;

the beverage basket comprising a pouch clip for the first pouch end and a slanted floor for the second pouch end such that the pouch may be positioned substantially vertically therein for good evacuation of the beverage from the pouch, wherein the beverage basket comprises one or more walls extending beyond a bottom of the slanted floor such that the beverage basket stands thereon without tipping when the pouch is positioned therein.

2. The beverage dispensing system of claim 1, wherein the pouch comprises a flexible thermoplastic.

3. The beverage dispensing system of claim 1, wherein the housing comprises an insulated thermoplastic.

4. The beverage dispensing system of claim 1, wherein the housing comprises a door enclosing the interior product space.

5. The beverage dispensing system of claim 1, further comprising a dispensing mechanism extending through the removable product shelf and attachable to the second pouch end of the pouch, wherein the dispensing mechanism is positioned forward of the drainage tube.

6. The beverage dispensing system of claim 1, wherein the one or more walls of the beverage basket comprise hand grips therein.

7. The beverage dispensing system of claim 1, wherein the slanted floor comprises a pouch aperture therein.

8. The beverage dispensing system of claim 1, wherein the pouch clip comprises an attachment end and an extended lip.

9. The beverage dispensing system of claim 1, wherein the housing and the beverage basket are made in a rotational molding process.

10. The beverage dispensing system of claim 1, wherein the number of beverages comprises non-carbonated beverages.

11. The beverage dispensing system of claim 1, wherein the one or more walls of the beverage basket comprise a first side wall, a second side wall, and a rear wall, and wherein the beverage basket comprises a front support bar connecting the first side wall with the second side wall above the slanted floor.

12. The beverage dispensing system of claim 11, wherein the pouch clip is attached to the rear wall.

13. A method of dispensing a beverage from a pouch, comprising:

chilling the pouch with the beverage therein in a refrigerator;

attaching a first end of the pouch to a beverage basket by a pouch clip;

positioning a second end of the pouch about a slanted floor of the beverage basket, wherein the beverage basket comprises one or more walls extending beyond a bottom of the slanted floor such that the beverage basket stands thereon without tipping when the pouch is positioned therein;

positioning a removable product shelf about a ledge within an insulated housing, wherein the removable product shelf separates an interior product space and from a dispensing area, and wherein the removable product shelf comprises a basket guide formed thereon and a drainage tube extending therethrough;

positioning the beverage basket on the basket guide of the removable product shelf within the interior product space of the insulated housing;

attaching the pouch to a dispensing mechanism;

dispensing a portion of the beverage from the pouch; and returning the beverage basket, the pouch, and any remaining beverage to the refrigerator.

14. A beverage dispensing system for dispensing a number of beverages, comprising:

an insulated housing comprising an interior product space and a dispensing area disposed below the interior product space;

a ledge disposed within the housing between the interior product space and the dispensing area;

a removable product shelf positionable about the ledge, wherein the removable product shelf separates the interior product space from the dispensing area, and wherein the removable product shelf comprises a basket guide formed thereon and a drainage tube extending therethrough;

a flexible pouch with one of the beverages therein;

the pouch comprising a first pouch end and a second pouch end;

a beverage basket removably positionable on the basket guide of the removable product shelf within the interior product space of the housing; and a dispensing mechanism attachable to the pouch;

the beverage basket comprising a pouch clip for the first pouch end and a slanted floor for the second pouch end such that the pouch may be positioned substantially vertically therein and attached to the dispensing mechanism for good evacuation of the beverage from the pouch, wherein the beverage basket comprises one or more walls extending beyond a bottom of the slanted floor such that the beverage basket stands thereon without tipping when the pouch is positioned therein.

15. The beverage dispensing system of claim 14, wherein the dispensing mechanism extends through the removable product shelf.

16. The beverage dispensing system of claim 14, wherein the beverage basket comprises one or more walls with hand grips therein.

17. The beverage dispensing system of claim 14, wherein the pouch clip comprises an attachment end and an extended lip.

* * * * *